US011107452B2

(12) United States Patent
Won

(10) Patent No.: US 11,107,452 B2
(45) Date of Patent: Aug. 31, 2021

(54) THREE-DIMENSIONAL ASYMMETRIC LATTICE STRUCTURE FOR TAILORING THE BAND GAPS

(71) Applicant: Yong Suk Won, Goyang-si (KR)

(72) Inventor: Jae Hoon Won, Toronto (CA)

(73) Assignee: Yong Suk Won

( * ) Notice: Subject to any disclaimer, the term of this patent is extended or adjusted under 35 U.S.C. 154(b) by 560 days.

(21) Appl. No.: 16/114,595

(22) Filed: Aug. 28, 2018

(65) Prior Publication Data

US 2019/0066648 A1 Feb. 28, 2019

(30) Foreign Application Priority Data

Aug. 29, 2017 (KR) ..... 10-2017-0109073

(51) Int. Cl.
*G10K 11/162* (2006.01)
*G10K 11/172* (2006.01)
*G10K 11/04* (2006.01)

(52) U.S. Cl.
CPC ..... *G10K 11/162* (2013.01); *G10K 11/04* (2013.01); *G10K 11/172* (2013.01)

(58) Field of Classification Search
CPC .... G10K 11/162; G10K 11/172; G10K 11/16; G10K 11/04
See application file for complete search history.

(56) References Cited

U.S. PATENT DOCUMENTS 5,505,035 A * 4/1996 Lalvani ..... E04B 1/19 52/648.1
6,554,826 B1 * 4/2003 Deardorff ..... A61N 7/02 181/176
8,094,023 B1 * 1/2012 El-Kady ..... G08B 13/14 340/572.1

(Continued)

FOREIGN PATENT DOCUMENTS

CN 2017-80774 U 3/2011
JP 2007-264331 A 10/2007

(Continued)

OTHER PUBLICATIONS

A. Srikantha Phani et al., "Wave propagation in two-dimensional periodic lattices," J. Acoust. Soc. Am. 119 (4), Apr. 2006 Acoustical Society of America, pp. 1995-2005.

*Primary Examiner* — Forrest M Phillips
(74) *Attorney, Agent, or Firm* — Harness, Dickey & Pierce, P.L.C.

(57) ABSTRACT

Provided is an asymmetric three-dimensional lattice structure in which physical properties of a strut of a symmetric three-dimensional lattice structure is asymmetrically changed so as to adjust a band gap and a frequency range of a wave propagated in a particular direction in the three-dimensional lattice structure. An embodiment of the present disclosure also provides a lattice structure having six struts, four nodes, a first coating layer, and a second coating layer. The basic structure of the six struts is formed of polymer and the strut's basic structure has a same length L and radius r.

(Continued)

Some struts may have a different thickness ratio between the first coating layer and the second coating layer, or may be coated with different materials to thereby have different properties.

12 Claims, 7 Drawing Sheets

(56) References Cited

U.S. PATENT DOCUMENTS

| | | | | |
|---|---|---|---|---|
| 8,557,341 | B2 * | 10/2013 | Yang | G03F 7/0002 427/271 |
| 8,875,838 | B1 * | 11/2014 | Yano | G10K 11/16 181/286 |
| 9,058,798 | B2 * | 6/2015 | Walker | G10K 11/04 |
| 9,809,002 | B2 * | 11/2017 | Hundley | B29C 64/40 |
| 2013/0114936 | A1 * | 5/2013 | Dong | G02B 6/024 385/125 |
| 2014/0060960 | A1 | 3/2014 | Walker et al. | |
| 2016/0027425 | A1 * | 1/2016 | Cook | F28F 1/00 428/221 |
| 2019/0130886 | A1 * | 5/2019 | Delpero | G10K 11/04 |
| 2019/0242110 | A1 * | 8/2019 | Rimoli | E04B 1/19 |
| 2021/0062970 | A1 * | 3/2021 | Pham | F16S 5/00 |

FOREIGN PATENT DOCUMENTS

| | | | |
|---|---|---|---|
| JP | 2007-304336 | A | 11/2007 |
| JP | 2013-543278 | A | 11/2013 |

* cited by examiner

THREE-DIMENSIONAL ASYMMETRIC LATTICE STRUCTURE FOR TAILORING THE BAND GAPS

CROSS-REFERENCE TO RELATED APPLICATIONS

This application is based on and claims priority from Korean Patent Application No. 10-2017-0109073 filed on Aug. 29, 2017 in the Korean Intellectual Property Office, the disclosure of which is incorporated herein in its entirety by reference.

FIELD

The present invention relates to a three-dimensional asymmetric lattice structure for tailoring band gaps.

BACKGROUND

In the past, a research on wave propagation in a two-dimensional triangular lattice structure has been conducted in the paper authored by Phani et al. "A. Srikantha Phani, J. Woodhouse, and N. A. Fleck. Wave propagation in two-dimensional periodic lattices. *The Journal of the Acoustical Society of America,* 119(4):1995, 2006." Each lattice structure has n physical basis vectors, in which n is proportional to the number of the dimension of the lattice structure. In addition, the triangular lattice structure is composed of three struts in total and each strut is placed at a corner with an angle of 60 degrees. Thus, a two-dimensional triangular lattice structure has two physical basis vectors and a three-dimensional lattice structure has three physical basis vectors in total. The physical basis vector is configured to form overall repetitive lattice structures when a unit lattice is repeatedly piled in a direction of the physical basis vector. For example, the unit lattice of the three-dimensional lattice structure is piled in a direction of the physical basis vectors $e_1$, $e_2$, and $e_3$ to form the overall repetitive lattice structure. In comparison with three-dimensional symmetric lattice structures, however, a three-dimensional asymmetric lattice structure has rarely been researched.

The present invention is made to generate a three-dimensional periodic lattice structure and analyze a propagation behavior of a wave passing through the lattice structure in the generated periodic lattice structure.

In particular, the present invention is configured to analyze the propagation behavior of the wave in the periodic lattice structure piled as tetrahedral unit cells. Also, the propagation behavior of the wave in the lattice structure is estimated using a numerical model made by and used in the present invention when physical properties of a portion of the struts of the tetrahedral unit cell are changed.

For example, a density and Young's Modulus was used as design variables, and it has been conceived that a band gap and/or a frequency interval of wave propagation may be controlled, in case that a symmetric lattice structure is converted into an asymmetric lattice structure due to the change of a physical property in the strut of the symmetric lattice structure. Further, the band gap or the frequency interval in the asymmetric lattice structure can be controlled within a predictable range with greater freedom and details.

SUMMARY

Technical Solution

Provided is an asymmetric three-dimensional lattice structure in which physical properties of a strut of a symmetric three-dimensional lattice structure are asymmetrically changed so as to adjust the band gap and frequency range of a wave propagated in a particular direction in the three-dimensional lattice structure.

A tetrahedral lattice structure capable of adjusting the band gap through the asymmetric three-dimensional structure includes six struts, four nodes, a first coating layer, and a second coating layer. A fundamental structure of the six struts is formed of polymer, the struts each have a same length L and radius r. The first coating layer coats the struts and the second coating layer coats the first coating layer.

The four nodes are expressed in a Cartesian coordinate system:

a base node having a coordinate of (0,0,0), a first node having a coordinate of $$\left(\frac{L}{\sqrt{2}}, \frac{L}{\sqrt{2}}, 0\right),$$

a second node having a coordinate of $$\left(0, \frac{L}{\sqrt{2}}, \frac{L}{\sqrt{2}}\right),$$

and a third node having a coordinate of $$\left(\frac{L}{\sqrt{2}}, 0, \frac{L}{\sqrt{2}}\right).$$

The physical basis vector associated with the nodes may be defined as an $e_1$ vector orienting the first node from the base node, an $e_2$ vector orienting the second node from the base node, and an $e_3$ vector orienting the third node from the base node. In an embodiment of the present invention, the strut of the lattice structure is coated with the first coating layer and the second coating layer, a density or young's modulus of a strut using various methods may be adjusted, thereby allowing the lattice structure to have an asymmetric three-dimensional structure. For example, it may be considered when a thickness ratio between the first coating layer and the second coating layer of at least one strut is changed, or when a material of the first coating layer and the second coating layer of at least one strut is changed. In these cases, the lattice structure may be provided in which the band gap of the wave propagation is changed along a reciprocal basis vector of the basis vector.

Advantageous Effects

The property and band gap of the wave propagation can be tailored upon converting into an asymmetric lattice structure by adjusting a density or a Young's modulus of a portion of the struts in the lattice structure. Since the wave propagation property is controllable, it may be allowed to utilize the present invention for a specific application. In particular, the wave is not propagated in the band gap section, which makes it possible to filter specific waves. For instance, when it is necessary to block noise between an outer wall and a cabin of an aircraft, or when designing a noise barrier for construction, it is possible to diminish or block a wave (sound or vibration transmission) transmitted in a specific direction. In addition, since a position and range of the band gap may be switched depending on how to change the physical properties, it may be possible to control the wave propagation having a specific frequency range.

DRAWINGS

DETAILED DESCRIPTION

According to an embodiment of the present invention, a radius and a thickness ratio between two coating layers (a first coating layer and a second coating layer) of a basic structure of a specific strut in a symmetric lattice structure may be regulated, or a young's modulus or density of a specific strut (especially, the young's modulus) may be changed by applying a different material to the coating layers, thereby converting a symmetric lattice structure into an asymmetric lattice structure. Upon converting into the asymmetric lattice structure, an asymmetric lattice structure can be provided, in which a propagation behavior of waves into a specific direction or a plurality of directions can be changed, which results in the change in a dispersion curve and band gap of the wave propagation. Thus, a wave propagation to a specific direction (e.g., sound wave or vibration) can be diminished or blocked within a certain frequency range.

The technical advantage, characteristics, and the method to achieve the same will be described in detail with reference to the accompanying drawings and exemplary embodiments. The inventive concept of the present disclosure, however, is limited to the embodiments set forth herein, and may be modified in various different ways. The embodiments are to be considered illustrative and provided for those skilled in the art to understand the scope of the present disclosure. The appended claims are intended to cover all such modifications, enhancements, and other embodiments. In the meantime, it should be noted that the terms or language set forth in the specification are intended to describe embodiments and should not be interpreted as limiting the present disclosure. As used herein, the singular forms are intended to include the plural forms as well, unless the context clearly indicates otherwise. When an element, step, or operation is referred to as being "comprises" or "comprising," it shouldn't be construed to exclude addition or existence of one or more other elements, steps, or operations.

First, in order to describe the asymmetric lattice structure, it is necessary to describe how to generate a physical (direct) lattice structure along with the basics and background of the lattice structure in a direct space.

Generating Physical Lattice Structure

In order to generate a periodic lattice structure, a primitive unit cell should be first defined. The unit cell includes multiple nodes and struts, which are arranged with each other at a specific angle to form a desired structural shape.

Figure 1:
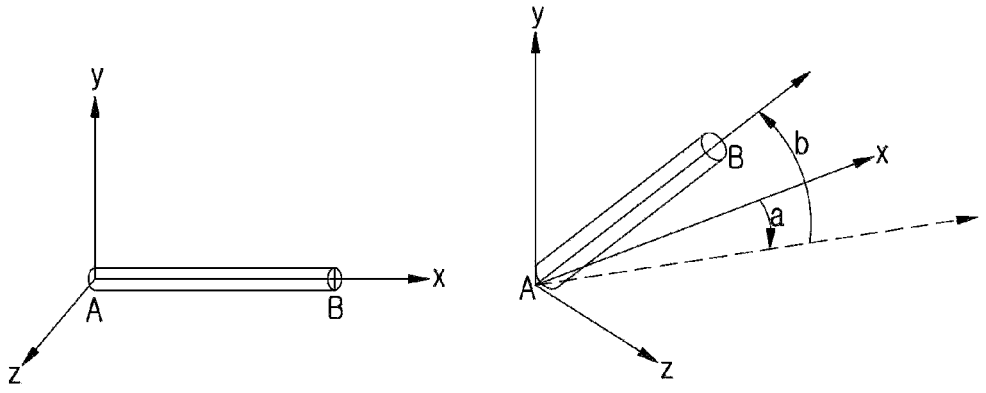
FIG. 1 is a view illustrating a strut placed in a local coordinate system and a direction and position of a strut displayed in a global coordinate system.

All of the struts included in the unit cell have a local coordinate system which is transversely placed along an x-axis direction. Each of the struts placed in the local coordinate system may be converted to be placed in a global coordinate system through a rotation of Euler angles $\alpha$, $\beta$, and $\gamma$ which are different from each other. FIG. 1 is a view illustrating a strut (left) placed in a local coordinate system and a direction and position of a strut (right) displayed in a global coordinate system. Here, $\alpha$ is an angle rotated with respect to y-axis, $\beta$ is an angle rotated with respect to z-axis, and $\gamma$ is an angle rotated with respect to a center axis of the strut.

Euler angle rotation is used to determine a direction and position of each strut constituting a unit lattice, and nodes assigned at opposite ends of each strut is required to express the connectivity of the nodes of the unit cell. For example, among the struts comprising a unit cell, if a left end of one strut is designated as node A and a right end thereof is designated as node B, and a left end of another strut is designated as node C and a right end thereof is designated as node A, upon connecting these two nodes, the same type of nodes designated to the struts should be placed so as to correspond to each other. According to this design mechanism, the two-dimensional or three-dimensional lattice structures can be generated.

Figure 2:
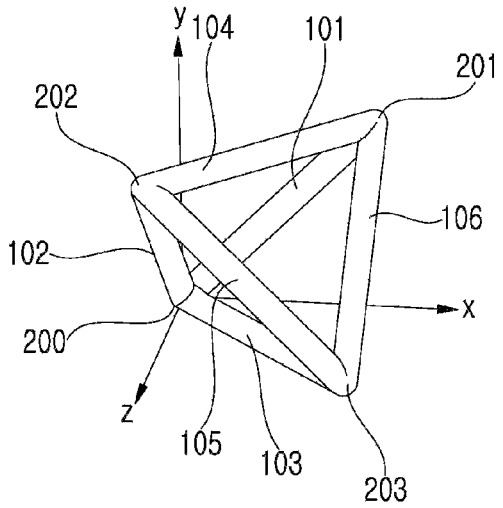
FIG. 2 is a view illustrating nodes and struts constituting a tetrahedral unit cell.

FIG. 2 is illustrating nodes and struts constituting a tetrahedral unit cell. A position of each node, i.e., a nodal position, may be expressed with Cartesian coordinates having x, y, and z coordinates in a three-dimensional space. For example, each node of a tetrahedron is formed by three struts bordering each other and four nodes in total can exist.

Considering a regular tetrahedron in which all struts have the same length, the four nodal positions in a Cartesian coordinate system are as follows:

a base node 200 having a coordinate of (0,0,0), a first node 201 having a coordinate of $$\left(\frac{L}{\sqrt{2}}, \frac{L}{\sqrt{2}}, 0\right),$$

a second node 202 having a coordinate of $$\left(0, \frac{L}{\sqrt{2}}, \frac{L}{\sqrt{2}}\right),$$

and a third node 203 having a coordinate of $$\left(\frac{L}{\sqrt{2}}, 0, \frac{L}{\sqrt{2}}\right).$$

A unit cell of the tetrahedron includes six struts, and the six struts may further include a first strut 101 connecting the base node and the first node, a second strut 102 connecting the base node and the second node, a third strut 103 connecting the base node and the third node, a fourth strut 104 connecting the first node and the second node, a fifth strut 105 connecting the second node and the third node, and a sixth strut 106 connecting the first node and the third node.

Figure 3:
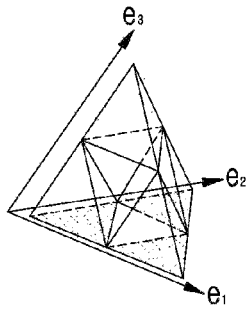
FIG. 3 is a view illustrating a tetrahedral lattice structure and physical basis vectors thereof.
Figure 4:
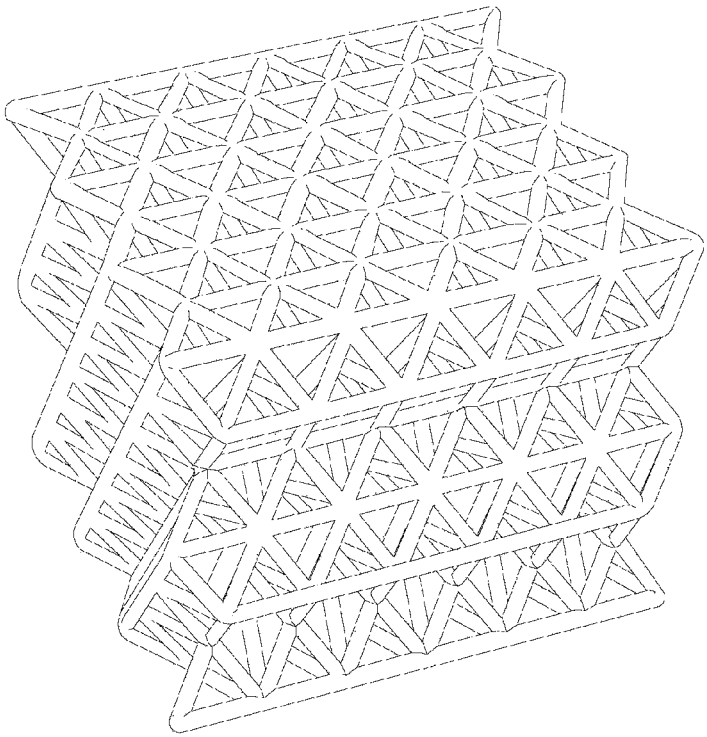
FIG. 4 is a view illustrating a repetitive lattice structure piled in directions of basis vectors of a tetrahedral unit cell.

FIG. 3 illustrates a tetrahedral lattice structure and physical basis vectors thereof The lattice structure in a physical region has n physical basis vectors, in which n is proportional to a number of the dimension of the lattice structure. Thus, a two-dimensional lattice structure has two physical basis vectors and a three-dimensional lattice structure has three physical basis vectors in total. The physical basis vector is configured to form overall repetitive lattice structures when the unit lattice is piled in a direction of the physical basis vector. For example, unit lattices of the three-dimensional lattice structure are piled in the directions of the physical basis vectors $e_1$, $e_2$, and $e_3$ to form an overall repetitive lattice structure. FIG. 4 is a view illustrating a repetitive lattice structure in which tetrahedral unit cells are piled in the directions of basis vectors.

Lattice Structures in the Wave Space: Reciprocal Lattice

A reciprocal lattice structure is a non-physical lattice structure which includes reciprocal basis vectors, and the reciprocal lattice structure can be obtained using the physical lattice structure (direct lattice) and the direct basis vectors constituting the physical lattice structure. The reciprocal lattice structure can be used throughout Finite Element Analysis which is for monitoring and analyzing a behavior of a wave propagation passing a structure in a lattice structure. A set of reciprocal vectors, $e_1^*$, $e_2^*$, and $e_3^*$, constituting the reciprocal lattice structure can be defined as follows:

$$e_1^* = 2\pi\frac{(e_2 \times e_3)}{e_1 \cdot (e_2 \times e_3)}$$

$$e_2^* = 2\pi\frac{(e_3 \times e_1)}{e_1 \cdot (e_2 \times e_3)}$$

$$e_3^* = 2\pi\frac{(e_1 \times e_2)}{e_1 \cdot (e_2 \times e_3)}$$

Wherein, $e_1$, $e_2$, and $e_3$ are direct lattice basis vectors and $e_1^*$, $e_2^*$, and $e_3^*$ are reciprocal lattice basis vectors. (Hereinafter, a reciprocal lattice basis vector is abbreviated to a reciprocal basis vector)

Figure 5:
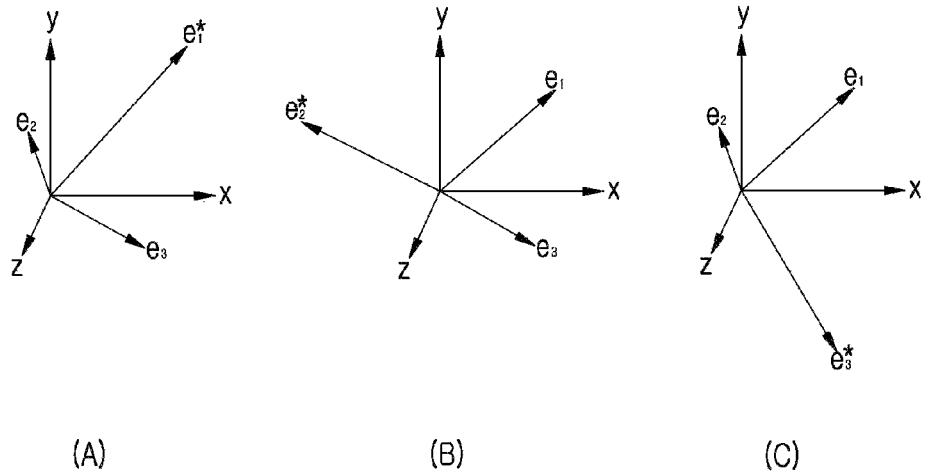
FIG. 5 is a view illustrating a relationship between basis vectors of a tetrahedral unit cell and reciprocal basis vectors of a unit lattice.

FIG. 5 illustrates a relationship between basis vectors of a tetrahedral unit cell and reciprocal basis vectors thereof. The reciprocal lattice structure in the three-dimensional tetrahedral lattice structure may be obtained by using the relationship between the basis vectors and the reciprocal basis vectors shown in the aforementioned equations. The three-dimensional tetrahedral unit cell has three basis vectors and three reciprocal basis vectors.

FIG. 5(A) shows a reciprocal basis vector $e_1^*$ which is perpendicular to the basis vectors $e_2$ and $e_3$. Thus, the reciprocal basis vector $e_1^*$ is a normal line to a plane made by the basis vectors $e_2$ and $e_3$ and the reciprocal basis vector $e_1^*$ is oriented to a same direction as a normal vector of the plane made by the basis vectors $e_2$ and $e_3$.

In the same manner, FIG. 5(B) shows a reciprocal basis vector $e_2^*$ which is perpendicular to the basis vectors $e_1$ and $e_3$ and FIG. 5(C) shows a reciprocal basis vector $e_3^*$ which is perpendicular to the basis vectors $e_1$ and $e_2$.

In addition, all of the reciprocal basis vectors have an absolute value of.

$$\frac{2\pi}{\text{Length of Unit Cell}}.$$

Figure 6:
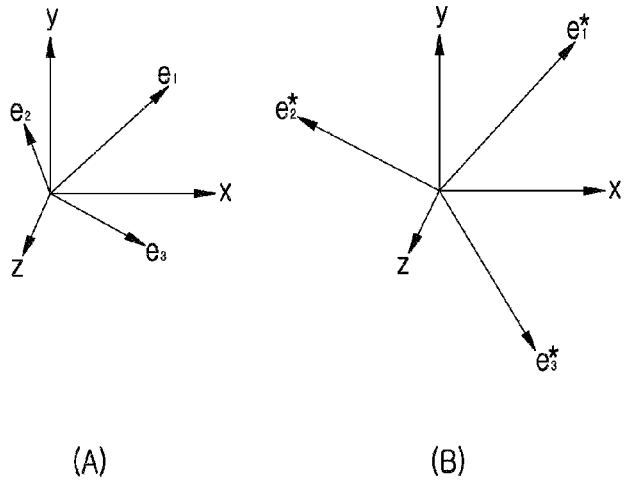
FIG. 6 is a view comparing basis vectors of a unit cell with reciprocal basis vectors thereof.

FIG. 6 is a view comparing basis vectors of a unit cell with reciprocal basis vectors thereof. FIG. 6(A) shows three basis vectors ($e_1$, $e_2$, and $e_3$) of a tetrahedral unit cell and FIG. 6(B) means three reciprocal basis vectors ($e_1^*$, $e_2^*$, and $e_3^*$) of the same tetrahedral unit cell.

Properties and Behavior of Wave Propagation in an Infinite Lattice Structure

Hereinafter, a method for modifying design variables to tailor the dispersion curve is described.

The generated lattice structure may include multiple design variables and these design variables can be modified to tailor a band gap of the dispersion curve of the lattice structure to meet a specific objective.

Figure 7:
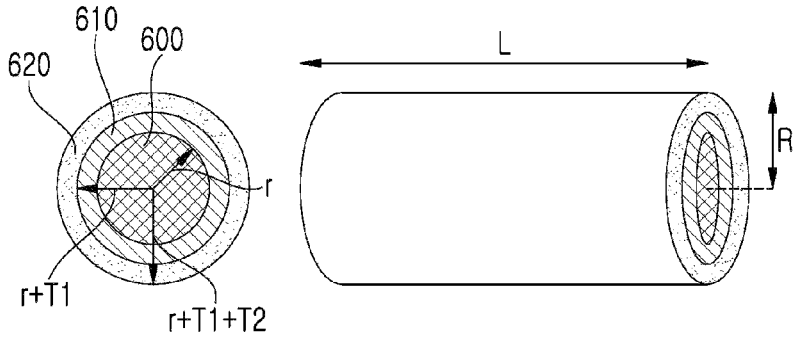
FIG. 7 is a view illustrating a structural configuration of each strut of a lattice structure.

FIG. 7 is a view illustrating a structural configuration of each strut of a lattice structure. The design variables and components which can be modified to tailor the lattice structure are described in Table 1.

TABLE 1

| Design Variables | Components of Lattice Structure |
|---|---|
| Young's Modulus, E | Polymer Substrate<br>Coating Layers |
| Density, P | Polymer Substrate<br>Coating Layers |
| Radius, R | Polymer Substrate |
| Thickness, (T1, T2) | Coating Layers |
| Length, L | Lattice Strut |

The lattice structure may be tailored by increasing or decreasing any components shown in Table 1 and the variable values thereof, which eventually has an influence on band gap phenomena in the dispersion curve. For the lattice structure utilized for an application of an aerospace industry, a structure having a high stiffness (Young's modulus) but a low density is preferred. As a result, in the following embodiments the design variables are changed to increase or decrease the Young's modulus and/or density.

The Young's modulus and density of an overall lattice structure can be adjusted in various ways by changing a radius r of a strut basic structure made of polymer and/or a thickness of a coating layer. For example, when the radius r of the strut basic structure 600 made of polymer alone is increased and a strut radius R of the overall lattice structure is maintained, the thickness T1 and T2 of the coating layers 610 and 620 may be thinner, which eventually results in the reduction in the Young's modulus and density of the overall lattice structure. On the other hand, if the radius r of the strut basic structure (fundamental skeleton structure) is decreased while the strut radius R of the overall lattice structure remains identical, both Young's modulus and density of the overall lattice structure may be increased.

For another example, when reducing all of the coating layer thicknesses while maintaining the strut radius R of the overall lattice structure, the Young's modulus and density of the overall lattice structure are both decreased. When increasing all of the coating layer thicknesses while maintaining the strut radius R of the overall lattice structure, the Young's modulus and density of the overall lattice structure are both increased. Accordingly, various combinations of the radius of the strut made of polymer and the coating layer thickness can alter the Young's modulus and density of the overall lattice structure.

Copper and nickel materials are used for coating according to an embodiment of the present invention, and specifically, the basic structure formed of polymer has a radius of r, T1 is the thickness of a copper layer, and T2 is the thickness of a nickel layer. These two materials have identical density, but different Young's modulus. Thus, referring to FIG. 7, if the coating layer thicknesses are altered while maintaining the radius r of the strut basic structure and the strut radius R of the overall lattice structure (for example, the copper coating layer becomes thicker whereas the nickel coating layer becomes thinner, or vice versa) and if the density of the overall lattice structure is not changed, regardless of the density, the Young's modulus of the overall lattice structure can only be changed.

TABLE 2

| | | |
|---|---|---|
| $E_{polymer}$ | 2.115 | Gpa |
| $\rho_{polymer}$ | 1170 | kg/m$^3$ |
| $E_{copper}$ | 58.6 | Gpa |
| $\rho_{copper}$ | 8900 | kg/m$^3$ |
| $E_{nickel}$ | 157.6 | Gpa |
| $\rho_{nickel}$ | 8900 | kg/m$^3$ |
| Radius of Polymer Strut, r | 1 | mm |
| Copper Coating Layer Thickness, T1 | 0.0125 | mm |
| Nickel Coating Layer Thickness, T2 | 0.0125 | mm |
| Length of Each Strut | 10.25 | m |

Based on the material combinations and design variables shown in Table 2, the Young's modulus of the overall lattice structure is calculated to 14.085 Gpa, and its density is 1542.5 kg/m$^3$. For example, assuming the design variables of Table 2 are used, if the radius r of the polymer basic structure remains 1 mm, the copper coating layer thickness is decreased by 0.01 mm, and the nickel coating layer thickness is increased by 0.01 mm, the Young's modulus of the overall lattice structure is changed into 17.754 Gpa but no change is made to the density thereof. These changes are because nickel has a high Young's modulus and its thickness increases while copper has a relatively low Young's modulus and its thickness decreases as much as the nickel thickness increases. Thus, the Young's modulus and density of all struts of the lattice structure (conversion to the symmetric lattice structure) or at least one strut or more (conversion to the asymmetric lattice structure) can be independently manipulated to analyze the dispersion curve in diverse settings of the lattice structure.

Properties of Dispersion Curve

The dispersion curve shows how a wave is propagated at a different velocity in a different frequency. Two velocities may be found in an unnormalized dispersion curve; a phase velocity and a group velocity. A secant slope as a slope of a line connecting an origin of the dispersion curve coordinate and a point of interest represents the phase velocity. On the contrary, a tangent slope which is a slope of a tangential line at the target coordinate represents the group velocity. The dispersion curve draws the frequency for each wave number. The frequency has a unit of "radians per second" and the wave number has a unit of "radians per unit-distance" (e.g., radians per meter). Since the frequency in the dispersion curve is drawn along a y-axis and the wave number is drawn along an x-axis, the slope of the dispersion curve shows the following information:

$$\text{Slope in Dispersion Curve} = \frac{\text{frequency}}{\text{wave number}} = \frac{\text{radians/second}}{\text{radians/meter}} = \frac{\text{meter}}{\text{second}} = \text{Unit of Velocity}$$

Figure 8:
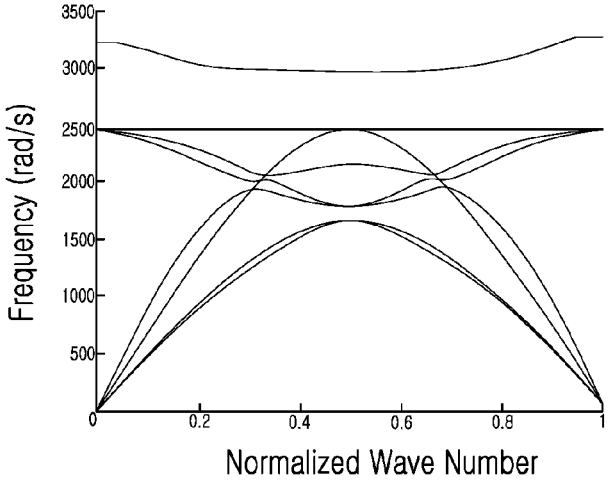
FIG. 8 is a view illustrating a dispersion curve of a tetrahedral symmetric lattice structure which strut has a same length and thickness.

FIG. 8 is a view illustrating a dispersion curve of a tetrahedral symmetric lattice structure which strut has a same length and thickness. The wave propagated along the reciprocal basis vector $e_1$* is illustrated in the dispersion curve. Upon solving an eigenvalue problem using the input values of each wave number, multiple eigenfrequencies are outputted in response to the each (i.e., one) of the inputted wave numbers.

A line connecting the lowest eigenfrequencies among the eigenfrequency output values of each wave number can be a first dispersion branch of the dispersion curve. A line connecting the second lowest eigenfrequencies among the eigenfrequency output values of each wave number can be a second dispersion branch of the dispersion curve. By repeating this procedure, the multiple dispersion branches which are measured are included in the dispersion curve according to an embodiment of the present invention. Here, since there exist many eigenfrequencies for each of the wave numbers, if all dispersion branches are drawn with all of the eigenfrequencies, it is difficult to analyze. Therefore, approximately 14 dispersion branches are determined and depicted in the dispersion curve to show a band gap phenomenon. However, there exist dispersion branches which are depicted in almost the same shape, and it should be noted that these dispersion branches can be expressed as if there is a single line.

For example, the dispersion curve of FIG. 8 is shown as if it has been drawn with only 8 dispersion branches. This is because the multiple dispersion branches are placed very closely in the entire wave number section (all x-axis section). The section in which the multiple dispersion branches are placed very closely in FIG. 8 occurs near the eigenfrequency section.

Band Gap Phenomenon

If there is a space (or a gap) in which nothing exists between two adjacent dispersion branches in the dispersion curve, the gap is referred to as a band gap in the solid mechanics. No wave propagation occurs in the band gap. In other words, according to an embodiment of the present invention, the wave is not propagated in any directions between frequency ranges in which the band gap exists.

For example, the band gap phenomenon of FIG. 8 and the band gap position can be identified. The band gap in FIG. 8 exists in the frequency range of 2424-2957 rad/s which is located between the 13th and 14th dispersion branches, and no wave is propagated in this frequency range. The band gap phenomenon is one of the crucial properties, which may be considered for industrial application of the present invention, and thus, can be utilized for a specific application by means of controlling the frequency range in which band gap exists.

Described is a mathematical method to predict the frequency range in which the band gap phenomenon occurs in the dispersion curve of the tetrahedral structure. The eigenvalue problem of the initial symmetric lattice structure can be expressed the following relationship:

$$E_1K'_1\varphi=w_1^2\rho_1M'\varphi$$

The eigenvalue problem of the modified symmetric lattice structure can be expressed with the following relationship:

$$E_2K'_2\varphi=w_2^2\rho_2M'_2\varphi$$

Wherein, K' and M' are a mass matrix and a strength matrix, respectively. In case that the Young's modulus and density are changeable for all struts, these two values are identical, i.e., $K'_1=K'_2=K'$ and $M'_1=M'_2=M'$.

The two aforementioned eigenvalue problems can be expressed as follows:

$$E_1K'\varphi=w_1^2\rho_1M'\varphi$$

$$E_2K'\varphi=w_2^2\rho_2M'\varphi$$

By equating these two equations, the following relationship can be obtained.

$$\frac{w_2^2}{\frac{E_2}{\rho_2}}=\frac{w_1^2}{\frac{E_1}{\rho_1}}$$

Which is rearranged into $$w_2=w_1\sqrt{\frac{E_2\rho_1}{E_1\rho_2}}.$$

As such, the relationship of the default symmetric lattice structure, which is before the Young's modulus and/or density of all struts of the unit cell is changed, and the modified symmetric lattice structure can be expressed with a scalar multiple due to the ratio of the Young's modulus and density.

$$\sqrt{\frac{\text{ratio of } E}{\text{ratio of } \rho}}$$

This relationship can be confirmed by comparing the band gap positions of the default symmetric lattice structure before changing and the modified symmetric lattice structure. As shown in the example above, if the Young's modules of all of the unit cell's struts is increased 10 times higher than the default lattice structure, but no change is made to the density, the Young's modulus and density before and after the change may be expressed as follows:

$$\rho_2=\rho_1$$

$$E_2=10E_1$$

Wherein, $\rho_2$ is a final density, $\rho_1$ is an initial density, E2 is a modified Young's modulus, and $E_1$ is an original Young's modulus.

Using the relationship shown in the equation above, it is anticipated that the dispersion curve of the symmetric lattice structure after the change may be expanded by the $\sqrt{10}$ multiple (at a rate of) as compared with the dispersion curve of the symmetric lattice structure before the change. Accordingly, due to the change, it is also anticipated that the eigenfrequencies of the all of the wave numbers shown in the dispersion curve of the changed symmetric lattice structure can be the values which are obtained by multiplying respective eigenfrequencies of the all of the wave numbers shown in the dispersion curve of the default symmetric lattice structure before the change by $\sqrt{10}$. The band gap in the dispersion curve of the default symmetric lattice structure occurs in the frequency range between 2424 (a lower bound) and 2957 (an upper bound) rad/s. Thus, in order to anticipate the frequency range in which the band gap in the dispersion curve of the changed symmetric lattice structure occurs, the lower and upper bound frequencies of the band gap shown in the dispersion curve of the default symmetric lattice structure may be multiplied by $\sqrt{10}$, thereby allowing the band gap range of the modified lattice structure to be anticipated.

Impact of Changing the Design Variables for a Non-Symmetric Lattice Structure

In embodiments described below, a change is applied to the design variables for one or more struts of the default symmetric lattice structure to convert a symmetric lattice structure into an asymmetric lattice structure.

The strut basic structure of all of the struts of the symmetric lattice structure according to an embodiment of the present invention is coated with the first coating layer and the second coating layer, and the Young's modulus and density of a portion of the struts may be changed to be converted into the asymmetric lattice structure. For example, a radius r of a specific strut's basic structure and a thickness ratio of the two coating layers (the firs coating layer and the second coating layer) may be changed, or a different material may be used for the coating layers. However, if the same changes are made to all of the strut of the lattice structure, it ends up with the symmetric lattice structure. Thus, it is necessary to change the properties of a portion of the struts to make an asymmetric lattice structure. Provided are embodiments below showing the band gap change and property of the asymmetric lattice structure in which one strut, two struts, and three struts are modified.

Changes in Design Variables of One Strut

In an embodiment, the Young's modulus of a first strut placed along a basis vector $e_1$ of the tetrahedral symmetric lattice structure is increased by 10 times.

According to the embodiment, copper is used for the first coating layer and nickel is used for the second coating layer coating the first coating layer. Also, for the symmetric lattice structure according to an embodiment of the present invention, the relationship of the strut's basic structure, the first coating layer, and the second coating layer is determined as follows, referring to Table 2:

Radius r of a first strut's basis structure formed of polymer: Thickness T1 of a first coating layer=80:1

Radius r of a first strut's basis structure formed of polymer: Thickness T2 of a second coating layer=80:1

Radius r of a first strut's basis structure formed of polymer: Sum (T1+T2) of thickness T1 of a first coating layer and thickness T2 of a second coating layer=40:1

Length L of a first strut: Sum (r+T1+T2) of radius r of a first strut's basis structure formed of polymer, thickness T1 of a first coating layer, and thickness T2 of a second coating layer=10:1

Figure 9:
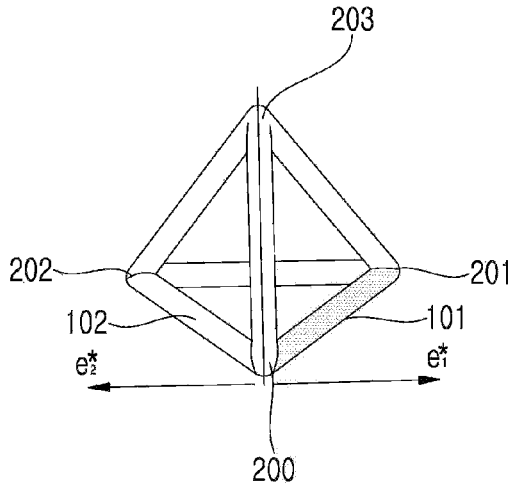
FIG. 9 is a view illustrating a change of a first strut of a tetrahedral symmetric lattice structure.

FIG. 9 is a view illustrating a change made to a first strut of a tetrahedral symmetric lattice structure. Referring to FIG. 9, the first strut 100 is understood as a strut connecting between the base node 200 and the first node 201. Here, the Young's modulus of the first strut 100 may be changed, e.g., by the ways of tailoring a radius of the strut's basic structure (the polymer portion) and a coating thickness ratio of the two coating layers, or coating the strut's basic structure with a coating material having a different property.

Simultaneously, the Young's moduli of the remaining 5 struts are not changed.

Figure 10:
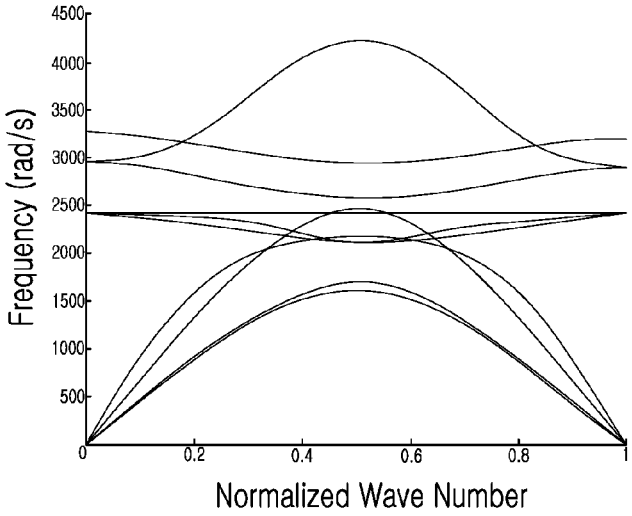
FIG. 10 is a view illustrating a dispersion curve of a wave propagating into a direction of a reciprocal basis vector $e_2$* of an asymmetric lattice structure of FIG. 9.

FIG. 10 is illustrating a dispersion curve of a wave propagating into a direction of a reciprocal basis vector $e_2$* of an asymmetric lattice structure when the Young's modulus of the first strut of the asymmetric lattice structure is increased by 10 times in the aforementioned conditions. The waves of the first 14 dispersion branches in the asymmetric lattice structure of FIG. 10 are propagated in the frequency range of as high as 4255 rad/s, and therefore, it may be confirmed that the wave propagation occurs in a higher frequency range in the asymmetric lattice structure as compared with the default symmetric lattice structure. Also, the wave of each dispersion branch in the asymmetric lattice structure is propagated in the higher frequency range as compared with the respective identical dispersion branch of the symmetric lattice structure, which shows that the waves in the asymmetric lattice structure are propagated at a higher phase velocity than the waves in the symmetric lattice structure. When it comes to the band gap phenomenon, for the dispersion curve of a wave propagating in the $e_2$* direction, the band gap exists in the frequency range of 2483-2597 rad/s, which is different from the band gap in the default symmetric lattice structure existing in the frequency range between 2424 (the lower bound) and 2957 (the upper bound) rad/s.

Figure 11:
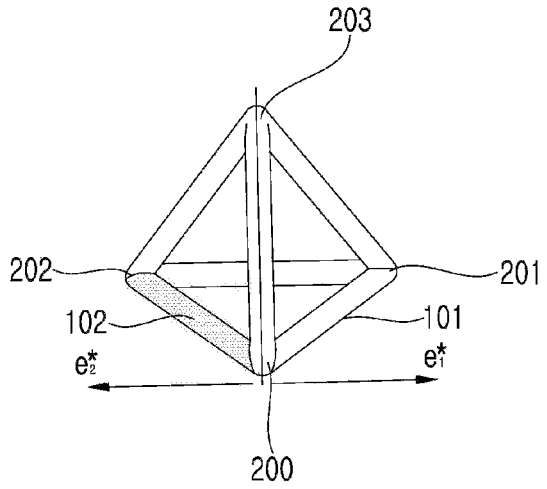
FIG. 11 is a view illustrating a change of a second strut of a tetrahedral symmetric lattice structure.

Referring to FIGS. 9 and 11, two waves propagating in the $e_1$* and $e_2$* direction may be considered. In FIGS. 9 and 11, each strut has a geometrically symmetric structure along the $e_1$ and $e_2$* direction which are the considered wave propagation direction with respect to a plane formed by y-axis and $e_3$*. In addition, the dispersion relationship of the wave propagating in the $e_1$* direction and the dispersion relationship of the wave propagating in the $e_2$* direction are symmetric to each other, which means two identical dispersion curves. The first strut 101 is changed to become asymmetric in the lattice structure of FIG. 9 and the second strut 102 is changed to be asymmetric in the lattice structure of FIG. 11. Here, the $e_2$* direction dispersion curve of the lattice structure in which the first strut 101 is modified (FIG. 9) (i.e., the dispersion curve of the wave propagating into the $e_2$* direction) and the $e_1$* direction dispersion curve of the lattice structure in which the second strut 102 is modified (i.e., the dispersion curve of the wave propagating into the $e_1$* direction) can be drawn in the same manner.

Additional cases are considered to analyze the band gap modification in more detail according to the change in the design variables in the asymmetric lattice structure.

Changes in Design Variables of Two Struts

In another embodiment, a case has been analyzed, in which the Young's moduli of two struts in the tetrahedral symmetric lattice structure are changed to thereby become asymmetric. For example, the design variables of the first and sixth struts 101 and 106 are simultaneously modified. Speaking of the changes in the design variables of the first and sixth struts 101 and 106, the Young's moduli of the struts are increased by 10 times while maintaining the densities thereof, as shown in Table 2.

Figure 12:
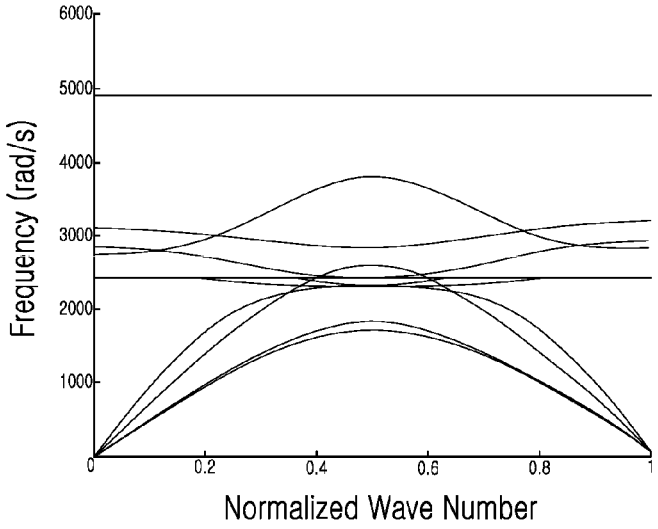
FIG. 12 is a view illustrating an $e_2$* direction dispersion curve when two struts (a first strut and a sixth strut) are changed in a tetrahedral symmetric lattice structure.

FIG. 12 is a view illustrating an $e_2$* direction dispersion curve when two struts (the first strut and the sixth strut) are changed. In the tetrahedral symmetric lattice structure, when two struts (the first and sixth struts) are changed to allow the lattice structure to become an asymmetric lattice structure, the wave is propagated between 39.81 and 4859 rad/s. In addition, the band gap exists between 3751 and 4859 rad/s.

Changes in Design Variables of Three Struts

In another embodiment, a case has been analyzed, in which the Young's moduli of three struts in the tetrahedral symmetric lattice structure are changed to become asymmetric. For example, the design variables of the first strut 101, the third strut 103, and the sixth strut 106 are simultaneously modified. Speaking of the changes in the design variables of the first, third and sixth struts 101, 103 and 106, the Young's moduli of the struts are increased by 10 times while maintaining the densities thereof, as shown in Table 2.

Figure 13:
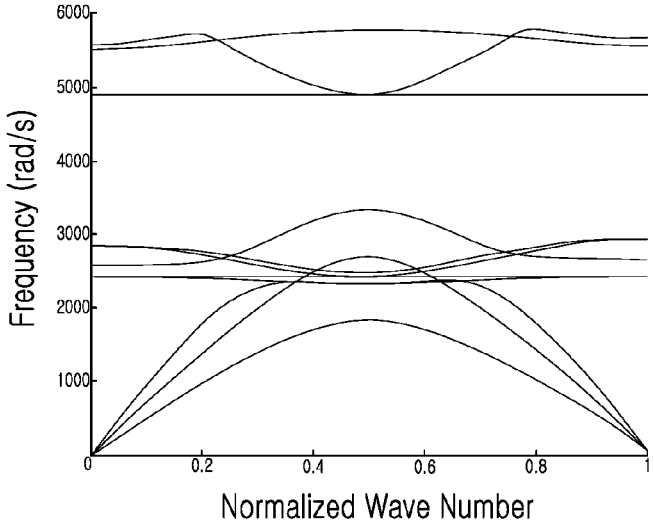
FIG. 13 is a view illustrating an $e_2$* direction dispersion curve when three struts (a first strut, a third strut, and a sixth strut) are changed in a tetrahedral symmetric lattice structure.

FIG. 13 is a view illustrating an $e_2$* direction dispersion curve when three struts (the first, third, and sixth struts) are changed. In a tetrahedral symmetric lattice structure, when three struts (the first, third, and sixth struts) are changed to allow the lattice structure to become an asymmetric lattice structure, the wave propagation frequency is expanded up to 5715 rad/s, and the band gap exists in a frequency range of 3279-4859 rad/s.

When Young's moduli of three struts are increased, in comparison with a case in which Young's moduli of two struts are increased, it may be confirmed from the dispersion curve that the frequency dispersion range is further increased. As the number of struts modified to increase the Young's modulus increases within a lattice structure, the range in which the frequency is measured in the dispersion curve is expanded.

In addition, the dispersion curve in which Young's moduli of two struts are increased shows a different band shape from the dispersion curve in which Young's moduli of three struts are increased. Due to the change in the band shape, it has been measured that the band gap frequency range where Young's moduli of three struts are increased is placed in a broader frequency range than the band gap frequency range where Young's moduli of two struts are increased. As the number of struts modified to increase the Young's modulus increases within a lattice structure, it has been identified that the band gap range is expanded (the change/difference of the band gap is caused by the change in the band shape).

Through exemplary embodiments, the property and band gap of the wave propagation can be tailored in case of converting into an asymmetric lattice structure by adjusting properties of struts of the symmetric lattice structure.

Since the wave propagation property is controllable, it may be allowed to utilize the present invention for a specific application. In particular, the wave is not propagated in the band gap section, when the frequency range in which the band gap exists is tailored, the present embodiments allow specific waves to be filtered out. For instance, when it is necessary to block noise between an outer wall and a cabin of an aircraft, or when designing a noise barrier for construction, it is possible to diminish or block a wave (sound or vibration transmission) transmitted in a specific direction. Also, since a position and range of the band gap may be switched depending on how to change the physical properties, it is possible to control the wave propagation having a specific frequency range.

It will be apparent to those of ordinary skilled in the art that various changes in form and detail may be made thereto without departing from the spirit or without changing essential features of the inventive concept. The above-disclosed subject matter is to be considered illustrative, and not restrictive, and the appended claims are intended to cover all such modifications, equivalents, enhancements, and other embodiments, which fall within the true spirit and scope of the present disclosure.

What is claimed is:

1. A lattice structure comprising:

six struts; and four nodes contacting three struts among the six struts, wherein the struts each comprise:

a strut basic structure having a radius r and a length L;

a first coating layer coating the strut basic structure with a thickness T1; and a second coating layer coating the first coating layer with a thickness T2;

wherein the four nodes are defined as a base node having a coordinate of (0,0,0) in a Cartesian coordinate system, a first node having a coordinate of $$\left(\frac{L}{\sqrt{2}}, \frac{L}{\sqrt{2}}, 0\right),$$

a second node having a coordinate of $$\left(0, \frac{L}{\sqrt{2}}, \frac{L}{\sqrt{2}}\right),$$

and a third node having a coordinate of $$\left(\frac{L}{\sqrt{2}}, 0, \frac{L}{\sqrt{2}}\right),$$

wherein basis vectors between the nodes are defined as an $e_1$ vector orienting the first node from the base node, an $e_2$ vector orienting the second node from the base node, and an $e_3$ vector orienting the third node from the base node, wherein when a ratio between the thickness of the first coating layer and the thickness of the second coating layer of at least one strut is changed to allow the lattice structure to have an asymmetric three-dimensional structure, a band gap of wave propagation varies along reciprocal basis vectors of the basis vectors.

2. The lattice structure of claim 1, wherein a material of the first coating layer is copper.

3. The lattice structure of claim 1 or 2, wherein a material of the second coating layer is nickel.

4. The lattice structure of claim 1, wherein a ratio of the radius (r) of the strut basic structure to the thickness (T1) of the first coating layer is 80 to 1.

5. The lattice structure of claim 1, wherein a ratio of the radius (r) of the strut basic structure to the thickness (T2) of the second coating layer is 80 to 1.

6. The lattice structure of claim 1, wherein a ratio of the radius (r) of the strut basic structure to a sum of the thickness (T1) of the first coating layer and the thickness (T2) of the second coating layer is 40 to 1.

7. The lattice structure of claim 1, wherein a ratio of the length (L) of the strut basic structure to a sum of the radius (r) of the strut basic structure, the thickness (T1) of the first coating layer, and the thickness (T2) of the second coating layer is 10 to 1.

8. The lattice structure of claim 1, wherein when the ratio between the thickness of the first coating layer and the thickness of the second coating layer is changed, the strut in which a thickness ratio is changed has a same density as the strut in which a thickness ratio thereof is not changed, and a Young's modulus of the strut in which the thickness ratio is changed is increased.

9. The lattice structure of claim 1, wherein as a number of the struts in which a Young's modulus thereof is increased due to the change in the ratio between the thickness of the first coating layer and the thickness of the second coating layer increases, a frequency range of the wave propagation is enlarged.

10. A lattice structure comprising:

six struts; and four nodes contacting three struts among the six struts, wherein the struts each comprise:

a strut basic structure having a radius r and a length L;

a first coating layer coating the strut basic structure and formed of a first coating material; and a second coating layer coating the first coating layer and formed of a second coating material;

wherein the four nodes are defined as a base node having a coordinate of (0,0,0) in a Cartesian coordinate system, a first node having a coordinate of $$\left(\frac{L}{\sqrt{2}}, \frac{L}{\sqrt{2}}, 0\right),$$

a second node having a coordinate of $$\left(0, \frac{L}{\sqrt{2}}, \frac{L}{\sqrt{2}}\right),$$

and a third node having a coordinate of $$\left(\frac{L}{\sqrt{2}}, 0, \frac{L}{\sqrt{2}}\right),$$

wherein basis vectors between the nodes are defined as an $e_1$ vector orienting the first node from the base node, an $e_2$ vector orienting the second node from the base node, and an $e_3$ vector orienting the third node from the base node, wherein when a material of the first coating layer or the second coating layer of at least one strut is changed to allow the lattice structure to have an asymmetric three-dimensional structure, a band gap of wave propagation varies along reciprocal basis vectors of the basis vectors.

11. The lattice structure of claim 10, wherein when the material of the first coating layer or the second coating layer is changed, the strut in which the material is changed has a same density as the strut in which the material thereof is not changed, and a Young's modulus of the strut in which the material is changed is increased.

12. The lattice structure of claim 10, wherein as a number of the struts in which a Young's modulus thereof is increased due to the change in the material of the first coating layer or the second coating layer increases, a frequency range of the wave propagation is enlarged.

* * * * *